US012102902B2

(12) United States Patent
Wang et al.

(10) Patent No.: US 12,102,902 B2
(45) Date of Patent: Oct. 1, 2024

(54) AUTONOMOUS BALL MACHINES

(71) Applicant: Tennibot Inc., Auburn, AL (US)

(72) Inventors: Xianglin Wang, Auburn, AL (US); Haitham Ahmed Reda Eletrabi, Auburn, AL (US); David Wahlig, Auburn, AL (US)

(73) Assignee: TENNIBOT INC., Auburn, AL (US)

( * ) Notice: Subject to any disclaimer, the term of this patent is extended or adjusted under 35 U.S.C. 154(b) by 0 days.

(21) Appl. No.: 18/114,843

(22) Filed: Feb. 27, 2023

(65) Prior Publication Data

US 2023/0381623 A1 Nov. 30, 2023

Related U.S. Application Data

(63) Continuation of application No. 17/827,900, filed on May 30, 2022, now Pat. No. 11,612,799.

(51) Int. Cl.

| | |
|---|---|
| ***A63B 69/40*** | (2006.01) |
| ***A63B 24/00*** | (2006.01) |
| ***A63B 47/02*** | (2006.01) |
| ***A63B 69/38*** | (2006.01) |

(52) U.S. Cl.

CPC ..... *A63B 69/40* (2013.01); *A63B 24/0021* (2013.01); *A63B 47/021* (2013.01); *A63B 69/38* (2013.01); *A63B 2024/0025* (2013.01); *A63B 2220/806* (2013.01); *A63B 2220/833* (2013.01); *A63B 2225/50* (2013.01)

(58) Field of Classification Search

CPC ... A63B 69/40; A63B 24/0021; A63B 47/021; A63B 69/38; A63B 2024/0025; A63B 2220/806; A63B 2220/833; A63B 2225/50

See application file for complete search history.

(56) References Cited

U.S. PATENT DOCUMENTS

| | | | | |
|---|---|---|---|---|
| 5,464,208 | A | 11/1995 | Pierce | |
| 2017/0340943 | A1 | 11/2017 | Pierotti et al. | |
| 2020/0298067 | A1 | 9/2020 | Refaeli | |
| 2021/0038950 | A1* | 2/2021 | Sullivan | G05D 1/0212 |
| 2021/0128989 | A1* | 5/2021 | Legg | G05D 1/0094 |

FOREIGN PATENT DOCUMENTS

JP 2004080163 A 3/2004

OTHER PUBLICATIONS https://www.youtube.com/watch?v=Jhe1h-eip2Q (Year: 2020).*

* cited by examiner

*Primary Examiner* — Jeffrey S Vanderveen

(74) *Attorney, Agent, or Firm* — Eversheds Sutherland (US) LLP

(57) ABSTRACT

Systems, methods, and computer-readable media are disclosed for autonomous tennis assistant systems having autonomous ball machines such as an autonomous and interactive tennis ball ejection robot. Example methods include determining, by a device, the position of a first player on a tennis court, determining a first target location for a first tennis ball to be ejected toward the first player, generating a trajectory for the first tennis ball to reach the first target location, and causing ejection of the first tennis ball from the tennis ball ejection robot along the generated trajectory toward the first target location. A base station may be used to provide image data for use by the tennis ball ejection robot from one or more additional vantage points.

20 Claims, 10 Drawing Sheets

AUTONOMOUS BALL MACHINES

CROSS-REFERENCE TO RELATED APPLICATION

This application is a continuation of U.S. application Ser. No. 17/827,900, filed May 30, 2022, the entirety of which is hereby incorporated by reference.

BACKGROUND

Certain sports may be played with multiple people, such as tennis, volleyball, badminton, and so forth. However, players may desire to practice such sports alone. For example, a tennis player may desire to practice various tennis movements, but may not have an opponent. In addition, a player may use multiple tennis balls during a practice session and/or during a match. Retrieval of tennis balls, or other sports equipment for different sports, may be cumbersome and time consuming. Moreover, players may desire to keep track of performance metrics to enhance performance, which may be inaccurate if tracked manually due to human error. Additionally, relying on players' subjective determination of whether a ball has landed within or outside the boundary lines of a tennis court may be highly erroneous. Accordingly, autonomous tennis assistant systems may be desired.

BRIEF DESCRIPTION OF THE DRAWINGS

The detailed description is set forth with reference to the accompanying drawings. The drawings are provided for purposes of illustration only and merely depict example embodiments of the disclosure. The drawings are provided to facilitate understanding of the disclosure and shall not be deemed to limit the breadth, scope, or applicability of the disclosure. In the drawings, the left-most digit(s) of a reference numeral may identify the drawing in which the reference numeral first appears. The use of the same reference numerals indicates similar, but not necessarily the same or identical components. However, different reference numerals may be used to identify similar components as well. Various embodiments may utilize elements or components other than those illustrated in the drawings, and some elements and/or components may not be present in various embodiments. The use of singular terminology to describe a component or element may, depending on the context, encompass a plural number of such components or elements and vice versa.

DETAILED DESCRIPTION

Overview

During gameplay of certain games, such as tennis, badminton, pickle ball, and so forth, players may use a ball or other object. In some instances, more than one ball or object may be used. For example, during tennis, multiple tennis balls may be used during gameplay. Retrieval of tennis balls or other gameplay objects may be time consuming and cumbersome. Keeping track of performance metrics during practices and/or matches also may be time consuming, cumbersome, and inaccurate. Moreover, during matches, often times players are responsible for determining whether the opposing player's ball has landed within or outside the boundary lines of the tennis court, which may be unintentionally, or even intentionally, inaccurate. In addition, players may desire to practice on their own, without another human player.

Embodiments of the disclosure include autonomous tennis assistant systems that may include autonomous ball machines such as autonomous tennis ball ejection robots with optional tennis ball retrieval capabilities and base stations that can be used to not only retrieve and eject tennis balls autonomously, but also to capture various player performance metrics and automatically generate tennis statistics during gameplay or practice sessions.

Figure 1:
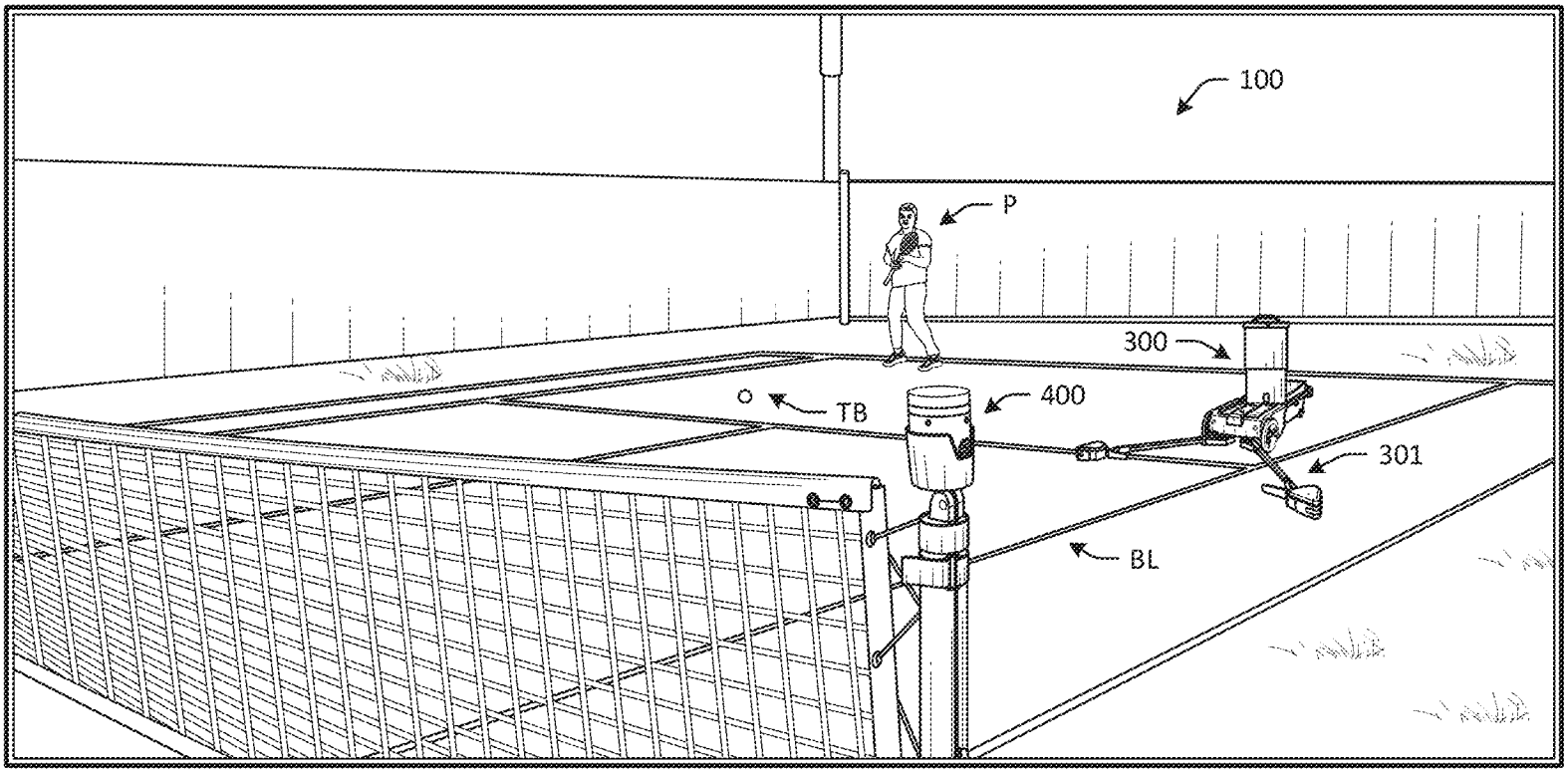
FIG. 1 is a schematic illustration of an autonomous tennis assistant system in accordance with one or more example embodiments of the disclosure.

Referring to FIG. 1, an autonomous tennis assistant system 100 is depicted in accordance with one or more example embodiments of the disclosure. For example, the system 100 may include an autonomous tennis ball ejection robot, e.g., a tennis ball ejection robot 200 (not shown) or tennis ball ejection robot 300, which may optionally have a ball retrieval portion 301, and a base station 400 in wireless communication with each other. The system 100 may be used to by one or more players P playing or practicing tennis on a tennis court having boundary lines BL using one or more tennis balls TB. Any number of balls may be used.

The system 100 may determine locations of one or more players on or around the tennis court, and may cause one or more tennis balls to be ejected toward the one or more players using the tennis ball ejection robot. For example, images of the tennis court and surrounding area captured by cameras disposed at the base station 400 and/or the tennis ball ejection robot may be processed using computer vision algorithms to detect boundaries of the court, including boundary lines BL as well as other edge boundaries such as fences or other obstacles, as well as other tennis balls. The tennis ball ejection robot may generate a trajectory for a ball to be ejected toward a player for practice play. For example, the trajectory may be generated based on which stroke, e.g., forehand or backhand or both, serve, or overhead, the player desires to practice. Accordingly, the tennis ball ejection robot may be positioned on the side of the court opposite to the player that is practicing, such that the tennis ball ejection robot is configured to eject balls along the generated trajectory over the net of the tennis court toward the target location within a predetermined distance from the player. As described in further detail below, the tennis ball ejection robot 300 may have wheels such that the tennis ball ejection robot 300 may autonomously navigate about the tennis court to eject balls along various trajectories at various angles relative to the player.

As shown in FIG. 1, the tennis ball ejection robot 300 may have a retrieval portion 301 configured to retrieve tennis balls on or around the tennis court. The tennis ball ejection robot and/or the base station 400 may detect one or more tennis balls on or around the tennis court, and generate a path to the location of the tennis balls and autonomously retrieve the tennis balls. For example, the tennis ball ejection robot and/or the base station 400 may detect a cluster of tennis balls, which may be a predetermined density or number of tennis balls within a certain area. The current location of tennis ball ejection robot relative to the detected tennis balls may be determined, such that the tennis ball ejection robot may autonomously navigate to the tennis balls. For example, a path may be planned to navigate through the ambient environment to the tennis balls, where obstacles can be detected in real-time and avoided. Upon contact with the tennis balls, the tennis ball ejection robot may retrieve the tennis balls using the retrieval portion 301. For example, the tennis ball ejection robot may retrieve the tennis balls by guiding the tennis balls towards a ball inlet on the tennis ball ejection robot using two arms of the retrieval portion 301, where the balls are propelled along a ball direction path into a ball collection device on the tennis ball ejection robot.

Example embodiments of the disclosure provide a number of technical features or technical effects. For example, in accordance with example embodiments of the disclosure, certain embodiments of the disclosure may automatically determine trajectories for the tennis balls to be ejected toward the player as well as the target locations of the tennis ball ejection robot for the ejections and/or autonomously eject tennis balls. Moreover, certain embodiments of the disclosure may automatically determine paths through ambient environments and/or autonomously retrieve tennis balls. As a result of improved functionality, embodiments may detect players and eject tennis balls, as well as detect and retrieve tennis balls in an efficient manner. The above examples of technical features and/or technical effects of example embodiments of the disclosure are merely illustrative and not exhaustive.

One or more illustrative embodiments of the disclosure have been described above. The above-described embodiments are merely illustrative of the scope of this disclosure and are not intended to be limiting in any way. Accordingly, variations, modifications, and equivalents of embodiments disclosed herein are also within the scope of this disclosure. The above-described embodiments and additional and/or alternative embodiments of the disclosure will be described in detail hereinafter through reference to the accompanying drawings.

Illustrative Structure and Use Cases

Figure 2C:
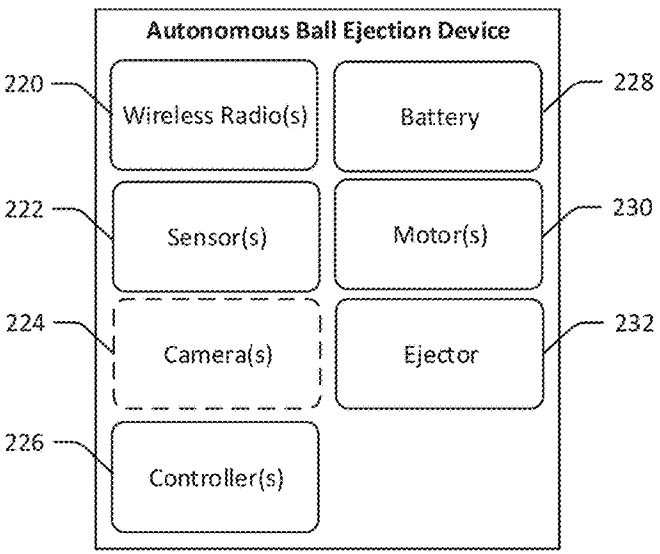
FIG. 2C schematically illustrates components of the exemplary tennis ball ejection device of FIGS. 2A and 2B in accordance with one or more example embodiments of the disclosure.
Figure 2B:
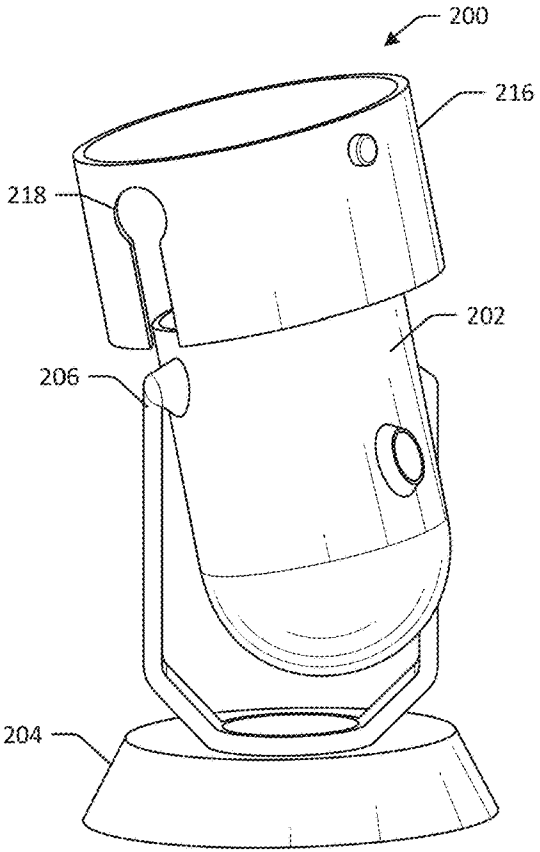
FIGS. 2A and 2B are schematic illustrations of various views of an exemplary tennis ball ejection device in accordance with one or more example embodiments of the disclosure.
Figure 2A:
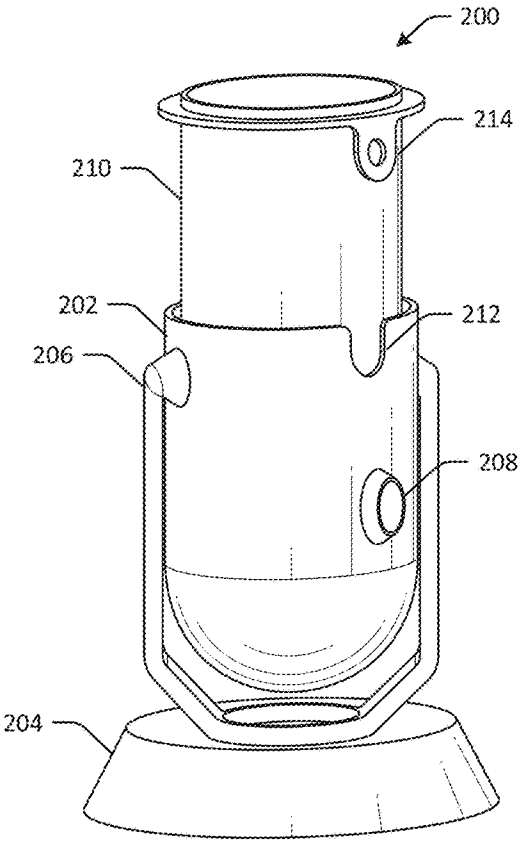

FIGS. 2A to 2C schematically illustrate components of an autonomous and interactive tennis ball ejection robot 200, in accordance with one or more example embodiments of the disclosure. Different embodiments may include different, additional, or fewer components than those illustrated in the examples of FIGS. 2A to 2C. The tennis ball ejection robot 200 may be the same tennis ball ejection robot discussed with respect to the other figures.

The tennis ball ejection robot 200 may be configured to eject one or more tennis balls autonomously, where the tennis ball eject robot 200 may detect one or more players on the tennis court and eject tennis balls toward the players along a generated trajectory, e.g., based on the stroke the players wish to practice. For example, the trajectories of the tennis balls may be generated so that the tennis balls may be ejected toward a target location within a predetermined distance from the player so that the player may practice their forehand, backhand, or overhead, and/or have to run toward the target location in order to hit the ball, thereby performing a high intensity cardio workout. Accordingly, the predetermined distance may be a small distance, e.g., 0-5 feet or more from the player, or a large distance, 5-10 feet or more from the player. The tennis ball ejection robot 200 may operate in conjunction with the base station 400, where the base station 400 may provide data from a different vantage point, such as elevated with respect to the tennis ball ejection robot 200, where the data can be used to eject and retrieve tennis balls, identify boundaries, identify player locations, identify obstacles, and/or other functionality.

As shown in FIGS. 2A and 2B, the tennis ball ejection robot 200 may include a housing 202 coupled to a base portion 204 via a hinged arm connector 206, such that the housing 202 may pivotally rotate relative to the base portion 204. For example, the hinged arm connector 206 may be coupled to and extend vertically from the base portion 204, and be pivotally coupled to the housing 202. The base portion 204 is configured to maintain the position of the tennis ball ejection robot 200 relative to the tennis court during operation. The electronic components of the tennis ball ejection robot 200 may be stored within the base 202. The housing 202 may have a cylindrical body having a ball inlet 208 sized and shaped to permit tennis balls, e.g., one tennis ball at a time, to be ejected therethrough. The housing 202 may be adjustably angled relative to the base portion 204 and fixed in position to provide the ball inlet 208 with a desired angle for ejecting tennis balls along the generated trajectory toward the player. The housing 202 may be angled relative to the base portion 204 manually by a user, or alternatively, the housing 202 may be automatically angled relative to the base portion 204 via electrical components of the tennis ball ejection robot 200 to provide the ball inlet 208 with the desired angle for ejecting tennis balls along the generated trajectory toward the player.

Moreover, the housing 202 may have an opening extending through a top portion of the housing 202, sized and shaped to removably receive a ball container 210. In some embodiments, the ball container 210 may be fixed to the housing 202. The ball container 210 may have an opening extending through a top portion of the container 210 for receiving tennis balls. The tennis balls stored within the container 210 may be guided within the tennis ball ejection robot 200 toward the ball inlet 208 for ejection therefrom. As shown in FIG. 2A, the housing 202 may include a groove 212 sized and shaped to receive a locking portion 214 of the ball container 210, to thereby maintain alignment of the container 210 relative to the housing 202 when the container 210 is inserted within the housing 202. For example, rotational movement between the container 210 and the housing 202 may be prevented when the locking portion 214 is engaged with the groove 212.

In addition, as shown in FIG. 2B, the tennis ball ejection robot 200 may include a cap 216 that is sized and shaped to be positioned over the top portion of the housing 202, e.g., when transporting and/or using the tennis ball ejection robot 200. Accordingly, when the cap 216 is positioned over the housing 202 in a compact transportation configuration, any tennis balls stored within the container 210 will be prevented from falling out of the tennis ball ejection robot 200. As shown in FIG. 2B, the cap 216 may have a groove 218 sized and shaped to receive at least a portion of the hinged arm connector 206, such that the cap 216 may be positioned over the housing 202 without colliding with the hinged arm connector 206 in the compact transport configuration.

As shown in FIG. 2C, in one example embodiment, the tennis ball ejection robot 200 may be an autonomous ball ejection device that includes one or more wireless radios 220, one or more sensors 222, one or more optional cameras 224, one or more controllers 226, one or more batteries 228, one or more motors 230, a ball ejector 232 and/or other components. The wireless radio 220 may be used to communicate wirelessly with other components, such as the base station 400, a user device, a remote server, and so forth. In some embodiments, the wireless radio 220 may be configured to broadcast a wireless network or hotspot in conjunction with an antenna. The sensors 222 may include any suitable sensor used for detection, such as ultrasonic sensors, proximity sensors, depth sensors, and so forth. The optional cameras 224 may include one or more cameras oriented to image a field of view in front of the tennis ball ejection robot 200, where the images or videos may be used to detect the presence of players and tennis balls. Other cameras may be used and may have different placement or positioning.

The controller 226 may include one or more computer processors coupled to memory and may be configured to control various operations of the tennis ball ejection robot 200, as described in further detail below. The batteries 228 may be configured to power the motors 230 of the tennis ball ejection robot 200, as well as various electronics. The batteries 228 may therefore be rechargeable. The motors 230 may actuate the ejector 232 to eject the tennis balls from the tennis ball ejection robot 200. Any number of motors may be included. In some embodiments, the ball ejector 232 is configured to translate vertically along a vertical axis of the tennis ball ejection robot 200 to eject the tennis balls from the ball inlet 208 of the tennis ball ejection robot 200 toward the player. Additionally, or alternative, the ball ejector 232 may be configured to rotate about a vertical axis of the tennis ball ejection robot 200 to eject the tennis balls from the ball inlet 208 of the tennis ball ejection robot 200 toward the player.

Figure 3C:
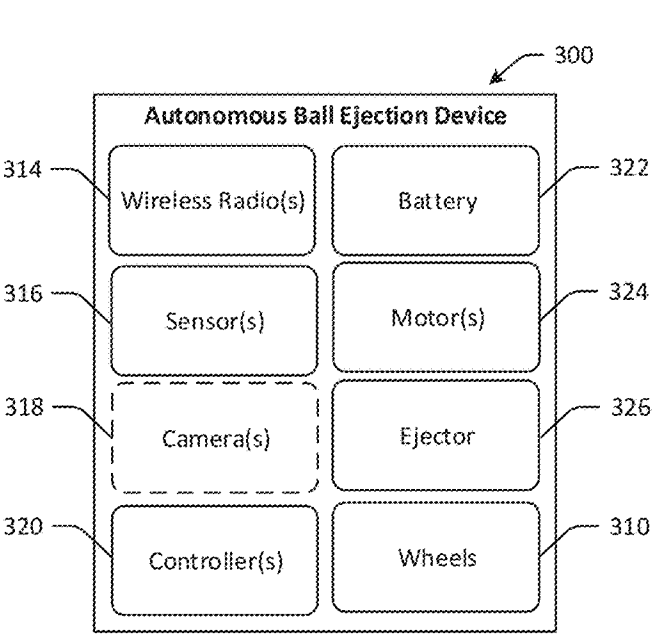
FIG. 3C schematically illustrates components of the exemplary tennis ball ejection device of FIGS. 3A and 3B in accordance with one or more example embodiments of the disclosure.
Figure 3B:
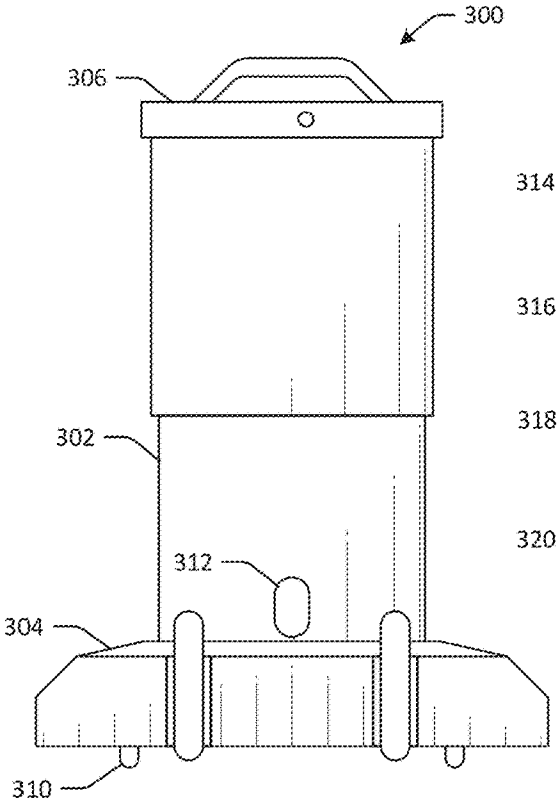
FIGS. 3A and 3B are schematic illustrations of various views of another exemplary tennis ball ejection device in accordance with one or more example embodiments of the disclosure.
Figure 3A:
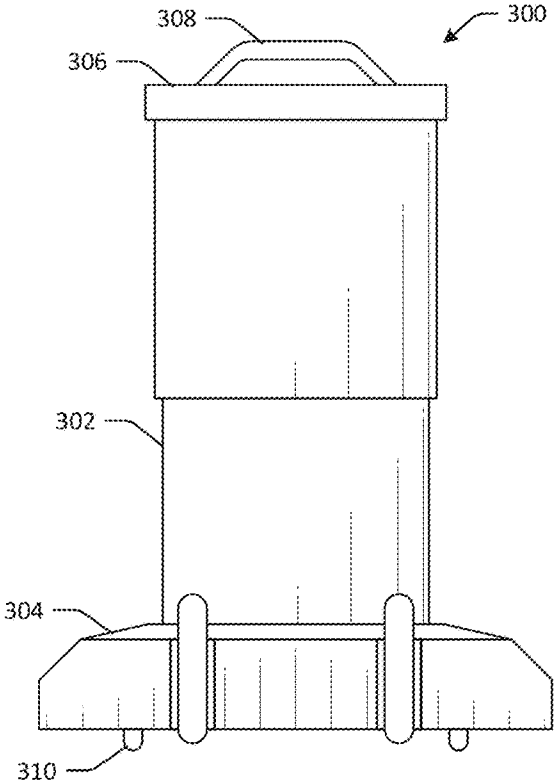

FIGS. 3A to 3C schematically illustrate components of an autonomous and interactive mobile tennis ball ejection robot 300, in accordance with one or more example embodiments of the disclosure. Different embodiments may include different, additional, or fewer components than those illustrated in the examples of FIGS. 3A to 3C. The tennis ball ejection robot 300 may be the same tennis ball ejection robot discussed with respect to the other figures.

Like the tennis ball ejection robot 200, the tennis ball ejection robot 300 may be configured to eject one or more tennis balls autonomously, where the tennis ball eject robot 300 may detect one or more players on the tennis court and eject tennis balls toward the players along a generated trajectory, e.g., based on the stroke the players wish to practice. For example, the trajectories of the tennis balls may be generated so that the tennis balls may be ejected toward a target location within a predetermined distance from the player so that the player may practice their forehand, backhand, or overhead, and/or have to run toward the target location in order to hit the ball, thereby performing a high intensity cardio workout. Moreover, the tennis ball ejection robot 300 may navigate around the tennis court during operation such that the tennis ball ejection robot 300 may strategically eject tennis balls from different locations on the tennis court relative to the player to provide various trajectories from various angles toward the player. The tennis ball ejection robot 300 may operate in conjunction with the base station 400, where the base station 400 may provide data from a different vantage point, such as elevated with respect to the tennis ball ejection robot 300, where the data can be used to eject and retrieve tennis balls, identify boundaries, identify player locations, identify obstacles, navigate the tennis court, and/or other functionality.

As shown in FIGS. 3A and 3B, the tennis ball ejection robot 300 may include a housing 302 coupled to a base portion 304 having a plurality of wheels 310, such that the base portion 304 may navigate the tennis ball ejection robot 300 about the tennis court. The electronic components of the tennis ball ejection robot 300 may be stored within the base 302. The housing 302 may have a cylindrical body having a ball inlet 312 sized and shaped to permit tennis balls, e.g., one tennis ball at a time, to be ejected therethrough. In some embodiments, the ball inlet 312 may be adjustably angled relative to the housing 302 to provide the ball inlet 312 with a desired angle for ejecting tennis balls along the generated trajectory toward the player. For example, the ball inlet 312 may be automatically angled relative to the housing 302 via electrical components of the tennis ball ejection robot 300 to provide the ball inlet 312 with the desired angle for ejecting tennis balls along the generated trajectory toward the player.

Moreover, the housing 302 may have an opening extending through a top portion of the housing 302, sized and shaped for receiving tennis balls. The tennis balls stored within the housing 302 may be guided within the tennis ball ejection robot 300 toward the ball inlet 312 for ejection therefrom. In addition, the tennis ball ejection robot 300 may include a lid 306 having a handle 308 that is sized and shaped to be positioned over the top portion of the housing 302, e.g., when transporting and/or using the tennis ball ejection robot 300. Accordingly, when the lid 306 is positioned over the housing 302 in a compact transportation configuration, any tennis balls stored within the housing 302 will be prevented from falling out of the tennis ball ejection robot 300.

As shown in FIG. 3C, in one example embodiment, the tennis ball ejection robot 300 may be an autonomous ball ejection device that includes one or more wireless radios 314, one or more sensors 316, one or more optional cameras 318, one or more controllers 320, one or more batteries 322, one or more motors 324, a ball ejector 326, a plurality of wheels 310, and/or other components. The wireless radios 314, sensors 316, cameras 318, controllers 320, and batteries 322 may be constructed and function similarly to wireless radios 220, sensors 222, cameras 224, controllers 226, and batteries 228 of the tennis ball ejection robot 200. Moreover, the sensors 316 may include any suitable sensor used for navigation, such as ultrasonic sensors, proximity sensors, depth sensors, and so forth. The controller 320 may include one or more computer processors coupled to memory and may be configured to control various operations of the tennis ball ejection robot 300, as described in further detail below.

The batteries 322 may be configured to power the motors 324 of the tennis ball ejection robot 300, as well as various electronics. One or more motors of the motors 324 may actuate the ejector 232 to eject the tennis balls from the tennis ball ejection robot 300. In addition, one or more motors of the motors 324 may actuate the plurality of wheels 310 for navigating the tennis ball ejection robot 300 in accordance with a planned navigation generated to provide various trajectories from various angles for the balls ejected from the tennis ball ejection robot 300 toward the player. Any number of motors may be included. In some embodiments, the ball ejector 326 is configured to translate vertically along a vertical axis of the tennis ball ejection robot 300 to eject the tennis balls from the ball inlet 312 of the tennis ball ejection robot 300 toward the player. Additionally, or alternative, the ball ejector 326 may be configured to rotate about a vertical axis of the tennis ball ejection robot 300 to eject the tennis balls from the ball inlet 312 of the tennis ball ejection robot 300 toward the player.

Figure 4B:
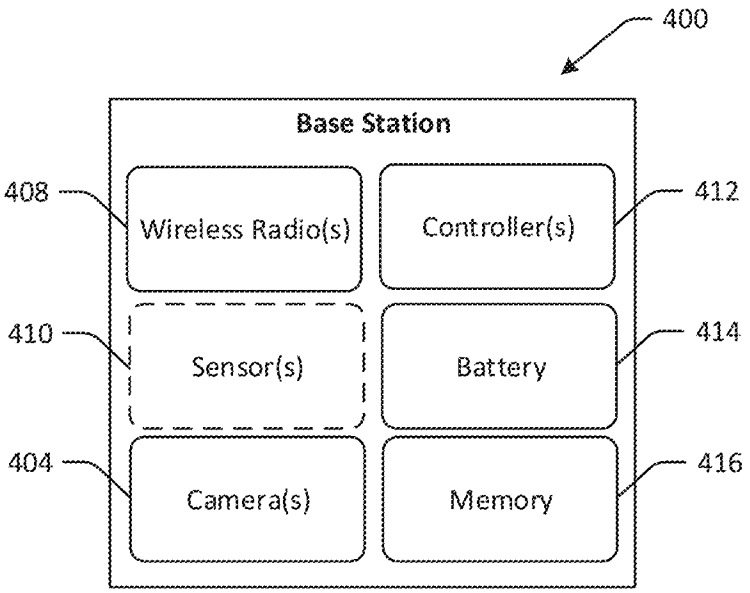
FIG. 4B schematically illustrates components of the exemplary base station of FIG. 4A in accordance with one or more example embodiments of the disclosure.
Figure 4A:
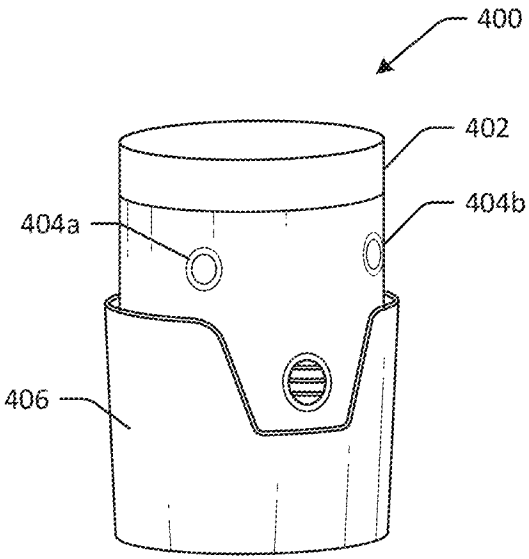
FIG. 4A is a schematic illustration of an exemplary base station in accordance with one or more example embodiments of the disclosure.

FIGS. 4A and 4B schematically illustrate components of a base station 400, in accordance with one or more example embodiments of the disclosure. Different embodiments may include different, additional, or fewer components than those illustrated in the examples of FIGS. 4A and 4B. The base station 400 may be the same base station discussed with respect to the other figures.

The base station 400 may be configured to communicate wirelessly with the tennis ball retrieval robots described herein, e.g., the tennis ball retrieval robot 200 and/or the tennis ball retrieval robot 300, and/or one or more remote servers. The base station 400 may operate in conjunction with the tennis ball ejection robots to detect players and tennis ball locations and eject and retrieve tennis balls. In some embodiments, the base station 400 may determine various performance metrics for users via images captured during gameplay. In addition, the base station 400 may determine whether a tennis ball landed within, outside, or on a boundary line, whether a point was scored, a ball speed of a tennis ball, topspin of a tennis ball, a type of stroke used to hit a tennis ball, whether a tennis match was won, hitting accuracy of a player, distance moved by a player, and/or other metrics based at least in part on video captured by one or more cameras of the base station 400.

As shown in FIG. 4A, the base station 400 may include a base station body 402, which may be removably coupled to a base station holder 406. The base station holder 406 may be secured to a net post of the tennis court, or another structure disposed on or adjacent to a tennis court. For example, the base station holder 406 may be secured to the net post using one or more straps. The base station holder 406 may remain coupled to the net post even when the base station body 402 is removed. The base station holder 406 may be configured to support the base station body 402 removably coupled thereto. In some embodiments, the base station holder 406 may include one or more apertures in a base platform to allow rain or other liquid to pass through instead of accumulating in the base station holder 406 when the base station body 402 is not disposed in the base station holder 406.

As shown in FIG. 4A, the base station 400 may include one or more cameras 400, e.g., first camera 404*a* and second camera 404*b*, oriented to image a field of view in front of the base station 400. For example, first camera 404*a* may be oriented towards a first side of a tennis court, and a second camera 404*b* may be oriented towards a second side of the tennis court. Other cameras may be used and may have different placement or positioning. The base station body 402 may be positioned in the base station holder 406 such that the first camera 404*a* and the second camera 404*b* are oriented toward the tennis court, and have an unobstructed view of the tennis court. The base station holder 400 may include one or more cutouts, such as that depicted in the example of FIG. 4A, to allow for heat dissipation and/or ambient environment exposure of additional sensors or components of the base station 400.

As shown in FIG. 4B, in one example embodiment, the base station 400 may be include one or more wireless radios 408, one or more optional sensors 410, one or more cameras 404, e.g., first camera 404*a* and second camera 404*b* described above, one or more controllers 412, one or more batteries 414, memory 416, and/or other components. The wireless radio 408 may be used to communicate wirelessly with other components, such as the tennis ball retrieval robots 200, 300, a user device, a remote server, and so forth. In some embodiments, the wireless radio 408 may be configured to broadcast a wireless network or hotspot in conjunction with an antenna. The optional sensors 410 may include any suitable sensor, such as ultrasonic sensors, proximity sensors, depth sensors, and so forth. The controller 412 may include one or more computer processors coupled to memory and may be configured to control various operations of the base station 400, as described in further detail below. The batteries 414 may be configured to power the base station 400. The batteries 414 may therefore be rechargeable. The memory 416 may be configured to store video captured using the camera 404.

Illustrative Device Architecture and Process

Figure 5:
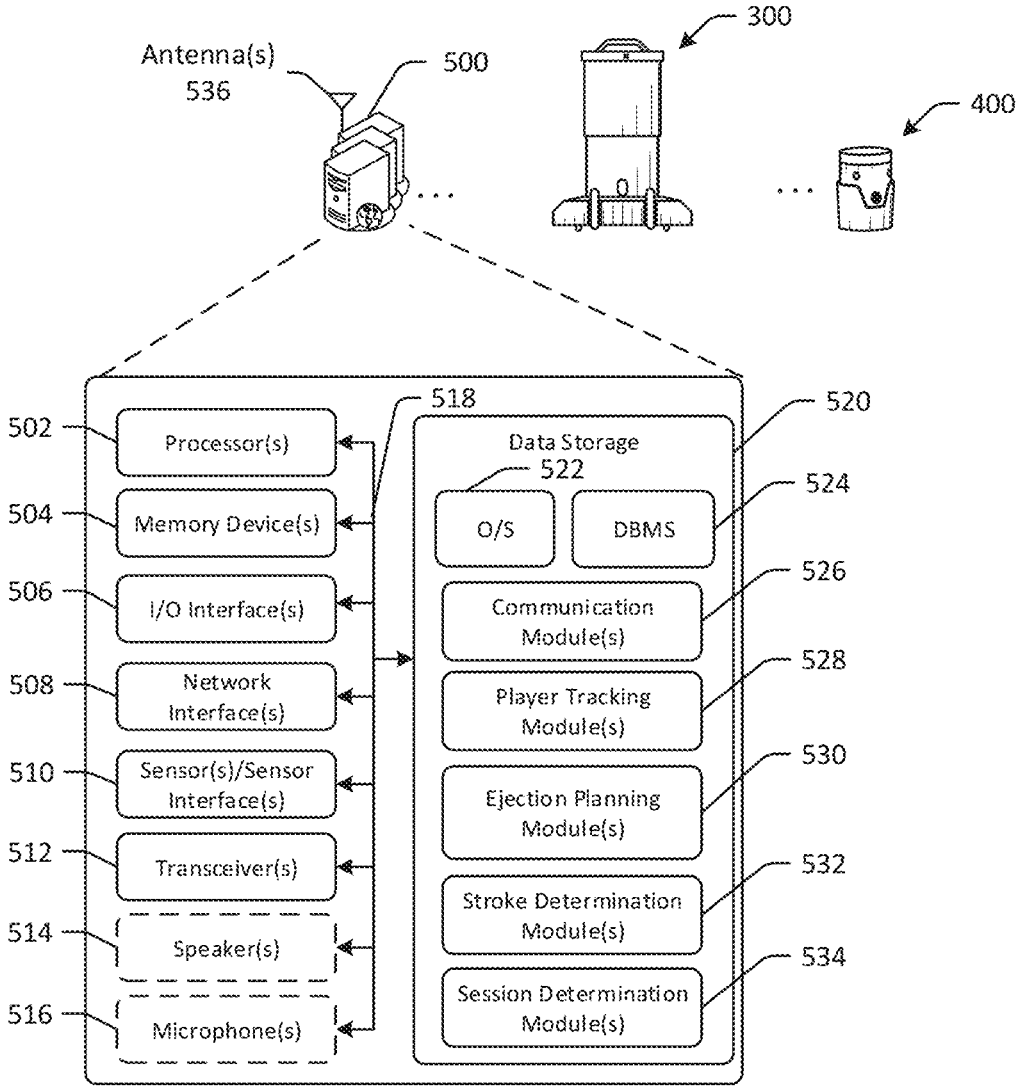
FIG. 5 is a schematic block diagram of an illustrative device for ejecting tennis balls in accordance with one or more example embodiments of the disclosure.

FIG. 5 is a schematic block diagram of a device 500, such as a base station, an autonomous tennis ball ejection robot, a remote server, a user device, and/or another device in communication with an autonomous tennis assistant system for ejecting balls and determining performance metrics, in accordance with one or more example embodiments of the disclosure. The device 500 may include any suitable computing device capable of receiving and/or generating data including, but not limited to, a mobile device such as a smartphone, tablet, e-reader, wearable device, or the like; a desktop computer; a laptop computer; a content streaming device; a set-top box; or the like. The device 500 may correspond to an illustrative device configuration for the devices of FIGS. 1-4.

The device 500 may be configured to communicate via one or more networks with one or more servers, user devices, or the like. In some embodiments, a single remote server or single group of remote servers may be configured to perform more than one type of path planning and/or navigation functionality. Example network(s) may include, but are not limited to, any one or more different types of communications networks such as, for example, cable networks, public networks (e.g., the Internet), private networks (e.g., frame-relay networks), wireless networks, cellular networks, telephone networks (e.g., a public switched telephone network), or any other suitable private or public packet-switched or circuit-switched networks. Further, such network(s) may have any suitable communication range associated therewith and may include, for example, global networks (e.g., the Internet), metropolitan area networks (MANs), wide area networks (WANs), local area networks (LANs), or personal area networks (PANs). In addition, such network(s) may include communication links and associated networking devices (e.g., link-layer switches, routers, etc.) for transmitting network traffic over any suitable type of medium including, but not limited to, coaxial cable, twisted-pair wire (e.g., twisted-pair copper wire), optical fiber, a hybrid fiber-coaxial (HFC) medium, a microwave medium, a radio frequency communication medium, a satellite communication medium, or any combination thereof.

In an illustrative configuration, the device 500 may include one or more processors (processor(s)) 502, one or more memory devices 504 (generically referred to herein as memory 504), one or more input/output (I/O) interface(s) 506, one or more network interface(s) 508, one or more sensors or sensor interface(s) 510, one or more transceivers 512, one or more optional speakers 514, one or more optional microphones 516, and data storage 520. The device 500 may further include one or more buses 518 that functionally couple various components of the device 500. The device 500 may further include one or more antenna(s) 536 that may include, without limitation, a cellular antenna for transmitting or receiving signals to/from a cellular network infrastructure, an antenna for transmitting or receiving Wi-Fi signals to/from an access point (AP), a Global Navigation Satellite System (GNSS) antenna for receiving GNSS signals from a GNSS satellite, a Bluetooth antenna for transmitting or receiving Bluetooth signals, a Near Field Communication (NFC) antenna for transmitting or receiving NFC signals, and so forth. These various components will be described in more detail hereinafter.

The bus(es) 518 may include at least one of a system bus, a memory bus, an address bus, or a message bus, and may permit exchange of information (e.g., data (including computer-executable code), signaling, etc.) between various components of the device 500. The bus(es) 518 may include, without limitation, a memory bus or a memory controller, a peripheral bus, an accelerated graphics port, and so forth. The bus(es) 518 may be associated with any suitable bus architecture including, without limitation, an Industry Standard Architecture (ISA), a Micro Channel Architecture (MCA), an Enhanced ISA (EISA), a Video Electronics Standards Association (VESA) architecture, an Accelerated Graphics Port (AGP) architecture, a Peripheral Component Interconnects (PCI) architecture, a PCI-Express architecture, a Personal Computer Memory Card International Association (PCMCIA) architecture, a Universal Serial Bus (USB) architecture, and so forth.

The memory 504 of the device 500 may include volatile memory (memory that maintains its state when supplied with power) such as random access memory (RAM) and/or non-volatile memory (memory that maintains its state even when not supplied with power) such as read-only memory (ROM), flash memory, ferroelectric RAM (FRAM), and so forth. Persistent data storage, as that term is used herein, may include non-volatile memory. In certain example embodiments, volatile memory may enable faster read/write access than non-volatile memory. However, in certain other example embodiments, certain types of non-volatile memory (e.g., FRAM) may enable faster read/write access than certain types of volatile memory.

In various implementations, the memory 504 may include multiple different types of memory such as various types of static random access memory (SRAM), various types of dynamic random access memory (DRAM), various types of unalterable ROM, and/or writeable variants of ROM such as electrically erasable programmable read-only memory (EEPROM), flash memory, and so forth. The memory 504 may include main memory as well as various forms of cache memory such as instruction cache(s), data cache(s), translation lookaside buffer(s) (TLBs), and so forth. Further, cache memory such as a data cache may be a multi-level cache organized as a hierarchy of one or more cache levels (L1, L2, etc.).

The data storage 520 may include removable storage and/or non-removable storage including, but not limited to, magnetic storage, optical disk storage, and/or tape storage. The data storage 520 may provide non-volatile storage of computer-executable instructions and other data. The memory 504 and the data storage 520, removable and/or non-removable, are examples of computer-readable storage media (CRSM) as that term is used herein.

The data storage 520 may store computer-executable code, instructions, or the like that may be loadable into the memory 504 and executable by the processor(s) 502 to cause the processor(s) 502 to perform or initiate various operations. The data storage 520 may additionally store data that may be copied to memory 504 for use by the processor(s) 502 during the execution of the computer-executable instructions. Moreover, output data generated as a result of execution of the computer-executable instructions by the processor(s) 502 may be stored initially in memory 504, and may ultimately be copied to data storage 520 for non-volatile storage.

More specifically, the data storage 520 may store one or more operating systems (O/S) 522; one or more database management systems (DBMS) 524; and one or more program module(s), applications, engines, computer-executable code, scripts, or the like such as, for example, one or more communication module(s) 526, one or more player tracking module(s) 528, one or more ejection planning module(s) 530, one or more stroke determination module(s) 532, and/or one or more session determination module(s) 534. Some or all of these module(s) may be sub-module(s). Any of the components depicted as being stored in data storage 520 may include any combination of software, firmware, and/or hardware. The software and/or firmware may include computer-executable code, instructions, or the like that may be loaded into the memory 504 for execution by one or more of the processor(s) 502. Any of the components depicted as being stored in data storage 520 may support functionality described in reference to correspondingly named components earlier in this disclosure.

The data storage 520 may further store various types of data utilized by components of the device 500. Any data stored in the data storage 520 may be loaded into the memory 504 for use by the processor(s) 502 in executing computer-executable code. In addition, any data depicted as being stored in the data storage 520 may potentially be stored in one or more datastore(s) and may be accessed via the DBMS 524 and loaded in the memory 504 for use by the processor(s) 502 in executing computer-executable code. The datastore(s) may include, but are not limited to, databases (e.g., relational, object-oriented, etc.), file systems, flat files, distributed datastores in which data is stored on more than one node of a computer network, peer-to-peer network datastores, or the like. In FIG. 5, the datastore(s) may include, for example, user profile information, user preference information, and other information.

The processor(s) 502 may be configured to access the memory 504 and execute computer-executable instructions loaded therein. For example, the processor(s) 502 may be configured to execute computer-executable instructions of the various program module(s), applications, engines, or the like of the device 500 to cause or facilitate various operations to be performed in accordance with one or more embodiments of the disclosure. The processor(s) 502 may include any suitable processing unit capable of accepting data as input, processing the input data in accordance with stored computer-executable instructions, and generating output data. The processor(s) 502 may include any type of suitable processing unit including, but not limited to, a central processing unit, a microprocessor, a Reduced Instruction Set Computer (RISC) microprocessor, a Complex Instruction Set Computer (CISC) microprocessor, a microcontroller, an Application Specific Integrated Circuit (ASIC), a Field-Programmable Gate Array (FPGA), a System-on-a-Chip (SoC), a digital signal processor (DSP), and so forth. Further, the processor(s) 502 may have any suitable microarchitecture design that includes any number of constituent components such as, for example, registers, multiplexers, arithmetic logic units, cache controllers for controlling read/write operations to cache memory, branch predictors, or the like. The microarchitecture design of the processor(s) 502 may be capable of supporting any of a variety of instruction sets.

Referring now to functionality supported by the various program module(s) depicted in FIG. 5, the communication module(s) 526 may include computer-executable instructions, code, or the like that responsive to execution by one or more of the processor(s) 502 may perform functions including, but not limited to, communicating with one or more devices, for example, via wired or wireless communication, communicating with remote servers, communicating with remote datastores, sending or receiving notifications, sending location data, determining localization parameters, determining device location, communicating with a base station and/or tennis ball ejection robot, determining path planning values, and the like.

The player tracking module(s) 528 may include computer-executable instructions, code, or the like that responsive to execution by one or more of the processor(s) 502 may perform functions including, but not limited to, determining the location of one or more players on the tennis court, identifying the player, performing computer vision on one or more images or video segments, determining movement and speed of the player, and the like.

The ejection planning module(s) 530 may include computer-executable instructions, code, or the like that responsive to execution by one or more of the processor(s) 502 may perform functions including, but not limited to, analyzing location data, extracting frames, determining obstacle positioning, determining navigation values, determining optimal trajectories, determining optimal ball inlet angle, determining boundaries, determining device speed, determining target ball ejection location, determining optimal robot position, and the like.

The stroke determination module(s) 532 may include computer-executable instructions, code, or the like that responsive to execution by one or more of the processor(s) 502 may perform functions including, but not limited to, determining ball location, performing computer vision on one or more images or video segments, determining ball speed, determining top spin, determining type of stroke, and the like.

The session determination module(s) 534 may include computer-executable instructions, code, or the like that responsive to execution by one or more of the processor(s) 502 may perform functions including, but not limited to, determining session type, e.g., practice or match, and/or practice stroke type, responsive to at least one of user input or automated player identification, or the like.

Referring now to other illustrative components depicted as being stored in the data storage 520, the O/S 522 may be loaded from the data storage 520 into the memory 504 and may provide an interface between other application software executing on the device 500 and hardware resources of the device 500. More specifically, the O/S 522 may include a set of computer-executable instructions for managing hardware resources of the device 500 and for providing common services to other application programs (e.g., managing memory allocation among various application programs). In certain example embodiments, the O/S 522 may control execution of the other program module(s) to dynamically enhance characters for content rendering. The O/S 522 may include any operating system now known or which may be developed in the future including, but not limited to, any server operating system, any mainframe operating system, or any other proprietary or non-proprietary operating system.

The DBMS 524 may be loaded into the memory 504 and may support functionality for accessing, retrieving, storing, and/or manipulating data stored in the memory 504 and/or data stored in the data storage 520. The DBMS 524 may use any of a variety of database models (e.g., relational model, object model, etc.) and may support any of a variety of query languages. The DBMS 524 may access data represented in one or more data schemas and stored in any suitable data repository including, but not limited to, databases (e.g., relational, object-oriented, etc.), file systems, flat files, distributed datastores in which data is stored on more than one node of a computer network, peer-to-peer network datastores, or the like. In those example embodiments in which the device 500 is a mobile device, the DBMS 524 may be any suitable light-weight DBMS optimized for performance on a mobile device.

Referring now to other illustrative components of the device 500, the input/output (I/O) interface(s) 506 may facilitate the receipt of input information by the device 500 from one or more I/O devices as well as the output of information from the device 500 to the one or more I/O devices. The I/O devices may include any of a variety of components such as a display or display screen having a touch surface or touchscreen; an audio output device for producing sound, such as a speaker; an audio capture device, such as a microphone; an image and/or video capture device, such as a camera; a haptic unit; and so forth. Any of these components may be integrated into the device 500 or may be separate. The I/O devices may further include, for example, any number of peripheral devices such as data storage devices, printing devices, and so forth.

The I/O interface(s) 506 may also include an interface for an external peripheral device connection such as universal serial bus (USB), FireWire, Thunderbolt, Ethernet port or other connection protocol that may connect to one or more networks. The I/O interface(s) 506 may also include a connection to one or more of the antenna(s) 536 to connect to one or more networks via a wireless local area network (WLAN) (such as Wi-Fi) radio, Bluetooth, ZigBee, and/or a wireless network radio, such as a radio capable of communication with a wireless communication network such as a Long Term Evolution (LTE) network, WiMAX network, 3G network, ZigBee network, etc.

The device 500 may further include one or more network interface(s) 508 via which the device 500 may communicate with any of a variety of other systems, platforms, networks, devices, and so forth. The network interface(s) 508 may enable communication, for example, with one or more wireless routers, one or more host servers, one or more web servers, and the like via one or more of networks.

The antenna(s) 536 may include any suitable type of antenna depending, for example, on the communications protocols used to transmit or receive signals via the antenna(s) 536. Non-limiting examples of suitable antennas may include directional antennas, non-directional antennas, dipole antennas, folded dipole antennas, patch antennas, multiple-input multiple-output (MIMO) antennas, or the like. The antenna(s) 536 may be communicatively coupled to one or more transceivers 512 or radio components to which or from which signals may be transmitted or received.

As previously described, the antenna(s) 536 may include a cellular antenna configured to transmit or receive signals in accordance with established standards and protocols, such as Global System for Mobile Communications (GSM), 3G standards (e.g., Universal Mobile Telecommunications System (UMTS), Wideband Code Division Multiple Access (W-CDMA), CDMA2000, etc.), 4G standards (e.g., Long-Term Evolution (LTE), WiMax, etc.), direct satellite communications, or the like.

The antenna(s) 536 may additionally, or alternatively, include a Wi-Fi antenna configured to transmit or receive signals in accordance with established standards and protocols, such as the IEEE 802.11 family of standards, including via 2.4 GHz channels (e.g., 802.11b, 802.11g, 802.11n), 5 GHz channels (e.g., 802.11n, 802.11ac), or 60 GHz channels (e.g., 802.11ad). In alternative example embodiments, the antenna(s) 536 may be configured to transmit or receive radio frequency signals within any suitable frequency range forming part of the unlicensed portion of the radio spectrum.

The antenna(s) 536 may additionally, or alternatively, include a GNSS antenna configured to receive GNSS signals from three or more GNSS satellites carrying time-position information to triangulate a position therefrom. Such a GNSS antenna may be configured to receive GNSS signals from any current or planned GNSS such as, for example, the Global Positioning System (GPS), the GLONASS System, the Compass Navigation System, the Galileo System, or the Indian Regional Navigational System.

The transceiver(s) 512 may include any suitable radio component(s) for—in cooperation with the antenna(s) 536—transmitting or receiving radio frequency (RF) signals in the bandwidth and/or channels corresponding to the communications protocols utilized by the device 500 to communicate with other devices. The transceiver(s) 512 may include hardware, software, and/or firmware for modulating, transmitting, or receiving—potentially in cooperation with any of antenna(s) 536—communications signals according to any of the communications protocols discussed above including, but not limited to, one or more Wi-Fi and/or Wi-Fi direct protocols, as standardized by the IEEE 802.11 standards, one or more non-Wi-Fi protocols, or one or more cellular communications protocols or standards. The transceiver(s) 512 may further include hardware, firmware, or software for receiving GNSS signals. The transceiver(s) 512 may include any known receiver and baseband suitable for communicating via the communications protocols utilized by the device 500. The transceiver(s) 512 may further include a low noise amplifier (LNA), additional signal amplifiers, an analog-to-digital (A/D) converter, one or more buffers, a digital baseband, or the like.

The sensor(s)/sensor interface(s) 510 may include or may be capable of interfacing with any suitable type of sensing device such as, for example, inertial sensors, force sensors, thermal sensors, and so forth. Example types of inertial sensors may include accelerometers (e.g., MEMS-based accelerometers), gyroscopes, and so forth.

The optional speaker(s) 514 may be any device configured to generate audible sound. The optional microphone(s) 516 may be any device configured to receive analog sound input or voice data.

Figure 6:
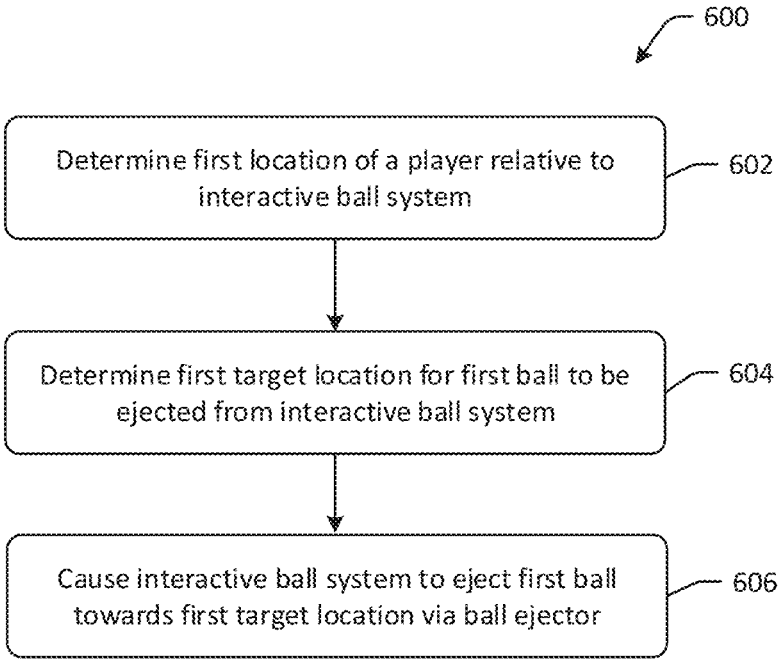
FIG. 6 is a schematic illustration of an example process flow for ejection of tennis balls in accordance with one or more example embodiments of the disclosure.

FIG. 6 is a schematic illustration of an example process flow 600 for ejection of tennis balls along trajectories in accordance with one or more example embodiments of the disclosure. While example embodiments of the disclosure may be described in the context of tennis balls and fences, it should be appreciated that the disclosure is more broadly applicable to any suitable type of round object for ejection. Some or all of the blocks of the process flows in this disclosure may be optional and may be performed in a distributed manner across any number of devices. The operations of the process flow 600 may be performed in a different order.

At block 602 of the process flow 600, computer-executable instructions stored on a memory of a device, such as a remote server, a tennis ball ejection robot, or a base station, may be executed to determine a first location of a first player relative to an autonomous and interactive tennis ball ejection robot, e.g., tennis ball ejection robot 200 or tennis ball ejection robot 300. To determine the first location of the first player, in some embodiments, a base station may capture one or more images of a tennis court area and may identify the location of the first player using computer vision. In other embodiments, the images may be sent to one or more remote servers for processing and corresponding coordinates of the first player may be received by the base station and/or tennis ball ejection robot. There may be more than one player, e.g., a second player or third player.

In some instances, locations of players may be identified by a tracking sensor worn by the player that transmits location data to the base station and/or the tennis ball ejection robot via wireless communication in real-time. Location coordinates may be determined as absolute positioning values or relative to components. For example, positional data may be relative to a current positioning of a tennis ball ejection robot or the tennis court net. In some embodiments, the location of the player may be determined based at least in part on data collected by the tennis ball ejection robot. For example, the tennis ball retrieval robot may detect the players via onboard cameras and/or sensors, and may map the player location based on camera and/or other sensor feedback during movement of the player.

At block 604 of the process flow 600, computer-executable instructions stored on a memory of a device, such as a remote server, a tennis ball ejection robot, or a base station, may be executed to determine a first target location for a first tennis ball to be ejected toward the player, and to generate a trajectory for ejection of the first tennis ball to reach the first target location. For example, the player may select from a plurality of practice modes, e.g., via a user input device operatively coupled to the tennis ball ejection robot and/or the base station, indicative of the type of practice desired by the player. For example, the player may select to practice their forehand, backhand, or both, overhead, serve, or a high intensity cardio mode, or any combination thereof. Accordingly, based on the selected mode, the first target location for the first ball may be selected to be a predetermined distance from the player, e.g., toward the player's forehand, toward the player's backhand, above the player's head, or further away from the player requiring the player to move toward the first target location.

In addition, the desired angle of the trajectory of the first tennis ball, e.g., between the position of the tennis ball ejection robot and the player, may be determined. For example, the tennis ball ejection robot may generate a trajectory for the first ball to be ejected directly toward the player, e.g., when the tennis ball ejection robot is positioned directly in front of the player, or at an angle, e.g., when the tennis ball ejection robot is positioned adjacent an opposite corner of the tennis court than the player.

At block 606 of the process flow 600, computer-executable instructions stored on a memory of a device, such as a remote server, a tennis ball ejection robot, or a base station, may be executed to cause the tennis ball ejection robot to eject the first tennis ball from the tennis ball ejection robot along the generated trajectory toward the first target location. In addition, if the desired position of the tennis ball ejection robot is in a different location on the tennis court than where the tennis ball ejection robot currently is, the tennis ball ejection robot may automatically navigate to the desired location, from which the tennis ball ejection robot will eject the tennis ball toward the player along the generated trajectory. Accordingly, the process flow 600 may be executed by one or more components of an autonomous tennis assistant system to eject tennis balls along predetermined trajectories toward the player.

Figure 7:
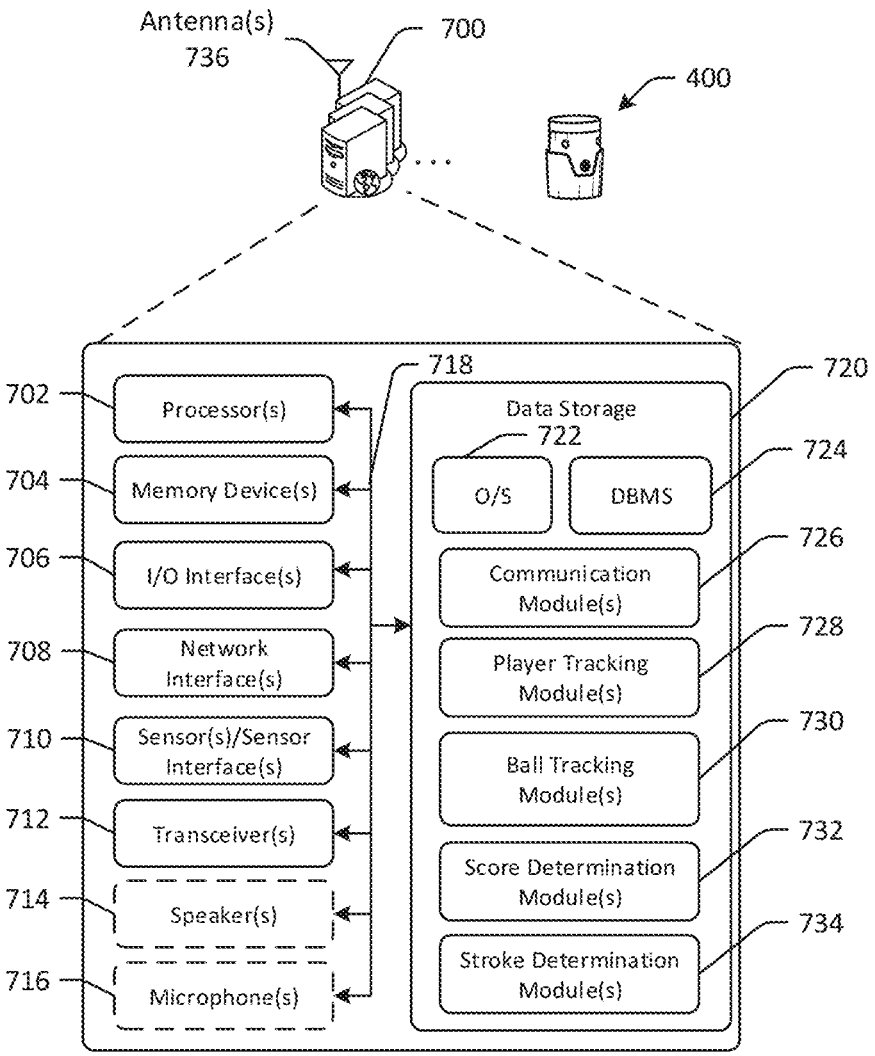
FIG. 7 is a schematic block diagram of an illustrative device for generating performance metrics in accordance with one or more example embodiments of the disclosure.

FIG. 7 is a schematic block diagram of a device 700, such as a base station, a remote server, a user device, and/or another device in communication with an autonomous tennis assistant system for determining performance metrics, in accordance with one or more example embodiments of the disclosure. The device 700 may include any suitable computing device capable of receiving and/or generating data including, but not limited to, a mobile device such as a smartphone, tablet, e-reader, wearable device, or the like; a desktop computer; a laptop computer; a content streaming device; a set-top box; or the like. The device 700 may correspond to an illustrative device configuration for the devices of FIGS. 1-4.

The device 700 may be configured to communicate via one or more networks with one or more servers, user devices, or the like. In some embodiments, a single remote server or single group of remote servers may be configured to perform more than one type of path planning and/or navigation functionality.

In an illustrative configuration, the device 700 may include one or more processors (processor(s)) 702, one or more memory devices 704 (generically referred to herein as memory 704), one or more input/output (I/O) interface(s) 706, one or more network interface(s) 708, one or more sensors or sensor interface(s) 710, one or more transceivers 712, one or more optional speakers 714, one or more optional microphones 716, one or more buses 718 that functionally couple various components of the device 700, data storage 720, and/or one or more antenna(s) 736, which may be constructed and function similar to one or more processors (processor(s)) 502, one or more memory devices 504, one or more input/output (I/O) interface(s) 506, one or more network interface(s) 508, one or more sensors or sensor interface(s) 510, one or more transceivers 512, one or more optional speakers 514, one or more optional microphones 516, one or more buses 518, data storage 520, and/or one or more antenna(s) 536 of device 500, respectively.

Accordingly, the processor(s) 702 may be configured to access the memory 704 and execute computer-executable instructions loaded therein. For example, the processor(s) 702 may be configured to execute computer-executable instructions of the various program module(s), applications, engines, or the like of the device 700 to cause or facilitate various operations to be performed in accordance with one or more embodiments of the disclosure.

Referring now to functionality supported by the various program module(s) depicted in FIG. 7, the communication module(s) 726 may include computer-executable instructions, code, or the like that responsive to execution by one or more of the processor(s) 702 may perform functions including, but not limited to, communicating with one or more devices, for example, via wired or wireless communication, communicating with remote servers, communicating with remote datastores, sending or receiving notifications, sending location data, determining localization parameters, determining device location, communicating with a base station and/or tennis ball ejection robot, determining path planning values, and the like.

The player tracking module(s) 728 may include computer-executable instructions, code, or the like that responsive to execution by one or more of the processor(s) 702 may perform functions including, but not limited to, determining the location of one or more players on the tennis court, identifying the player, performing computer vision on one or more images or video segments, determining movement and speed of the player, and the like.

The ball tracking module(s) 730 may include computer-executable instructions, code, or the like that responsive to execution by one or more of the processor(s) 702 may perform functions including, but not limited to, determining ball location, performing computer vision on one or more images or video segments, determining ball speed, determining top spin, determining accuracy of ball hits by a player, and the like.

The score determination module(s) 732 may include computer-executable instructions, code, or the like that responsive to execution by one or more of the processor(s) 702 may perform functions including, but not limited to, determining whether a ball lands without, outside, or on a boundary line of the tennis court, determining whether a player receives a point, determining when a match is won, determining and updating a score of a match, and the like.

The stroke determination module(s) 734 may include computer-executable instructions, code, or the like that responsive to execution by one or more of the processor(s) 702 may perform functions including, but not limited to, performing computer vision on one or more images or video segments, determining type of stroke, and the like.

Figure 8:
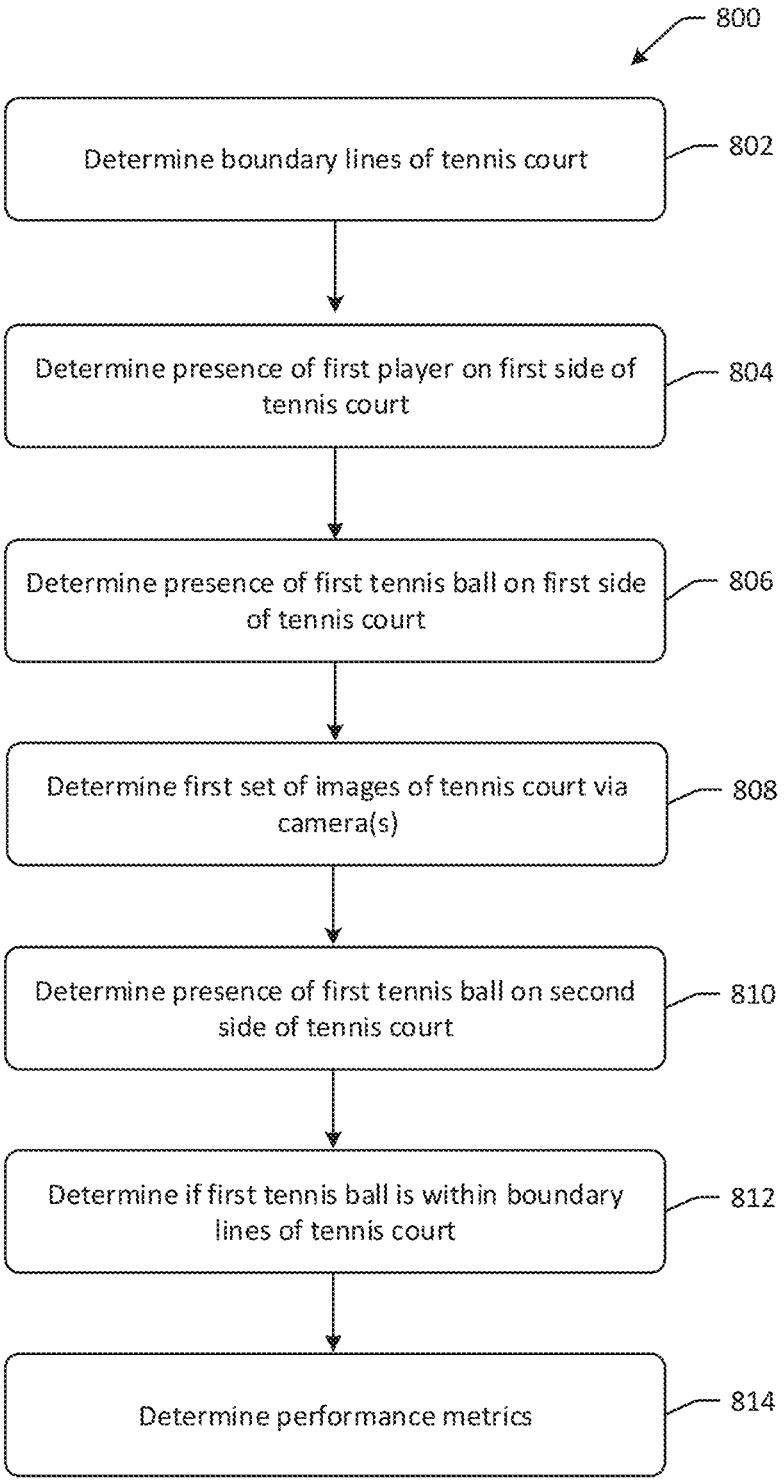
FIG. 8 is a schematic illustration of an example process flow for determination of performance metrics in accordance with one or more example embodiments of the disclosure.

FIG. 8 is a schematic illustration of an example process flow 800 for determining performance metrics, e.g., during a practice or match, in accordance with one or more example embodiments of the disclosure. While example embodiments of the disclosure may be described in the context of tennis balls and the game of tennis, it should be appreciated that the disclosure is more broadly applicable to any suitable type of round object and game. Some or all of the blocks of the process flows in this disclosure may be optional and may be performed in a distributed manner across any number of devices. The operations of the process flow 800 may be performed in a different order.

At block 802 of the process flow 800, computer-executable instructions stored on a memory of a device, such as a remote server, a base station, may be executed to determine an edge boundary of a tennis court. For example, an edge boundary may be the boundary lines of a tennis court, a wall, a fence, a net, etc. To determine the edge boundary, in some embodiments, a base station may capture one or more images of a tennis court area and may identify the edge boundary using computer vision. In other embodiments, the images may be sent to one or more remote servers for processing and corresponding coordinates of an edge boundary may be received by the base station. There may be more than one edge boundary, such as fences along both a lateral axis and longitudinal axis of the tennis court. In some instances, locations of edge boundaries may be identified by a user via one or more inputs at a user device. User inputs at a device may be communicated with a base station via wireless communication. Location coordinates may be determined as absolute positioning values or relative to components. For example, positional data may be relative to the boundary lines or the net of a tennis court.

At block 804 of the process flow 800, computer-executable instructions stored on a memory of a device, such as a remote server or a base station, may be executed to determine the presence and/or location of a first player on a first side of a tennis court. To determine the presence and/or location of the first player on the first side of the tennis court, in some embodiments, a base station may capture one or more images of a tennis court area and may identify the location of the first player using computer vision. In other embodiments, the images may be sent to one or more remote servers for processing and corresponding coordinates of the first player may be received by the base station. There may be more than one player, e.g., a second player, on the first side of the tennis court. In some instances, locations of players may be identified by a tracking sensor worn by the player that transmits location data to the base station via wireless communication in real-time. Location coordinates may be determined as absolute positioning values or relative to components. For example, positional data may be relative to the boundary lines or the net of the tennis court.

At block 806 of the process flow 800, computer-executable instructions stored on a memory of a device, such as a remote server or a base station, may be executed to determine the presence and/or location of a first tennis ball on the first side of a tennis court. For example, a base station may capture one or more images of a tennis court area and may identify the presence and/or location of the first tennis ball. The location of the first tennis ball may be determined to be within a predetermined distance, such as a number of inches or feet, relative to the first player on the first side of the court. The predetermined distance relative to the first player may be indicative of which stroke the first player uses to hit the ball, e.g., forehand, backhand, serve. etc.

At block 808 of the process flow 800, computer-executable instructions stored on a memory of a device, such as a remote server or a base station, may be executed to determine a first set of images, e.g., via one or more cameras of the base station, of the tennis court. For example, the base station may capture one or more images of a tennis court area.

At block 810 of the process flow 800, computer-executable instructions stored on a memory of a device, such as a remote server or a base station, may be executed to determine the presence and/or location of the first tennis ball on a second side of a tennis court, e.g., on the opposite side of the tennis court net from the first side of the tennis court. For example, the base station may analyze the first set of images of the tennis court area to identify the presence and/or location of the first tennis ball on the second side of the tennis court.

At block 812 of the process flow 800, computer-executable instructions stored on a memory of a device, such as a remote server or a base station, may be executed to determine the location of the first tennis ball relative to the boundary lines of the tennis court on the second side of the tennis court. For example, the first tennis ball may be determined to be outside, within, or on a boundary line of the second side of the tennis court, which may be indicative of whether the first tennis ball is "out" for purposes of scorekeeping.

At block 814 of the process flow 800, computer-executable instructions stored on a memory of a device, such as a remote server or a base station, may be executed to determine various performance metrics based on at least one the position data of the first ball and the first player on the first side of the tennis court as determined at blocks 804 and 806, the first set of image data indicative of the tennis court as determined at block 808, the position data of the first ball relative to the boundary lines of the second side of the tennis court as determined by blocks 802, 810, and 812. For example, based on the position data of the first ball and the first player on the first side of the tennis court, the ball speed of the first tennis ball, topspin of the first tennis ball, the type of stroke used to hit the first tennis ball, distance moved by the first player, etc. may be determined and stored for the duration of the practice session or match. Moreover, based on the position data of the first ball relative to the boundary lines of the second side of the court, whether a point was scored by the first player, whether a tennis match was won, hitting accuracy of the first player, etc. may be determined and stored for the duration of the practice session or match. As will be understood by a person having ordinary skill in the art, the process flow 800 may be used to determine position data of additional players, e.g., a first player on the first side of the tennis court and a second player on the second side of the tennis court, and/or a first and second player on the first side of the tennis court and a third and fourth player on the second side of the tennis court, as well as position data of one or more tennis balls being hit by any one of the players determined to be on the tennis court and their respective landing points on the tennis court relative to the boundary lines of the tennis court. Accordingly, at block 814, each score made by each player on the tennis court may be accumulated over the course of a match, until a winner of the match is determined based on the scores.

Figure 9A:
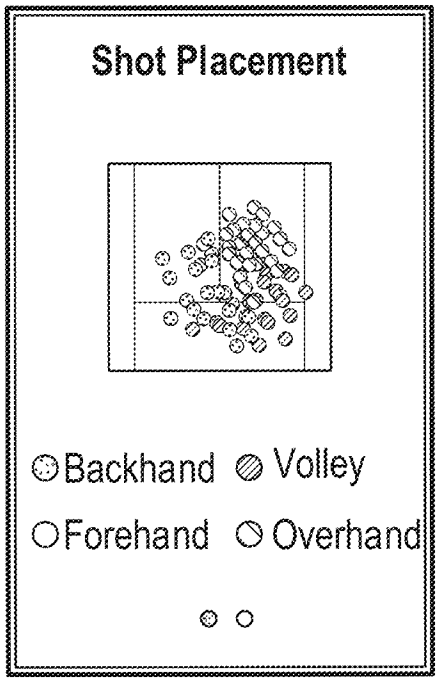
FIGS. 9A to 9E are schematic illustrations of example user interfaces generated by an autonomous tennis assistant system in accordance with one or more example embodiments of the disclosure.
Figure 9B:
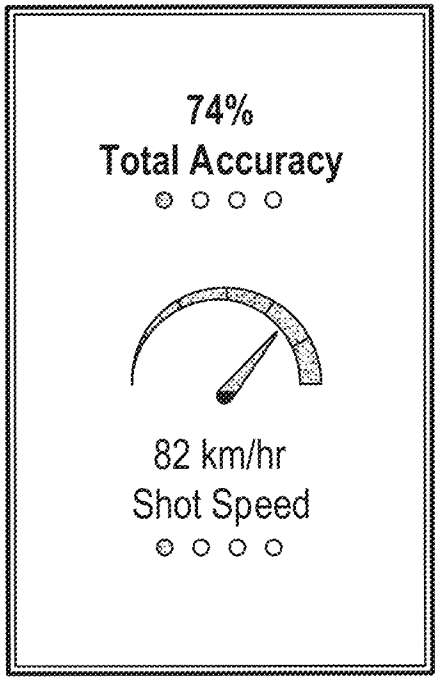
Figure 9C:
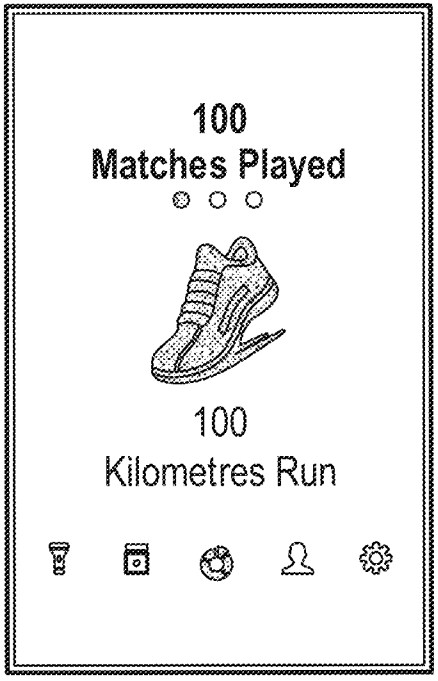
Figure 9D:
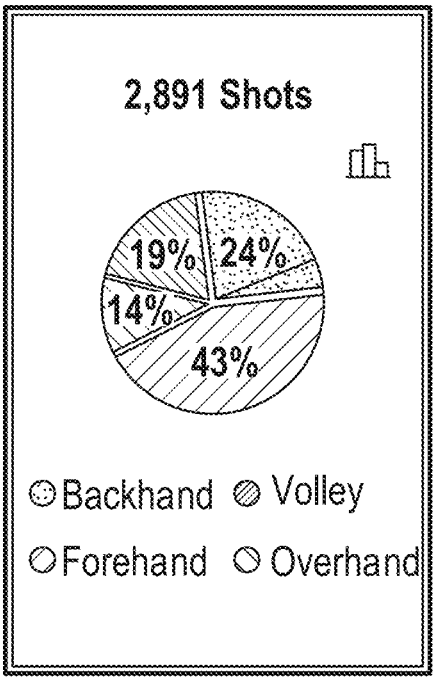
Figure 9E:
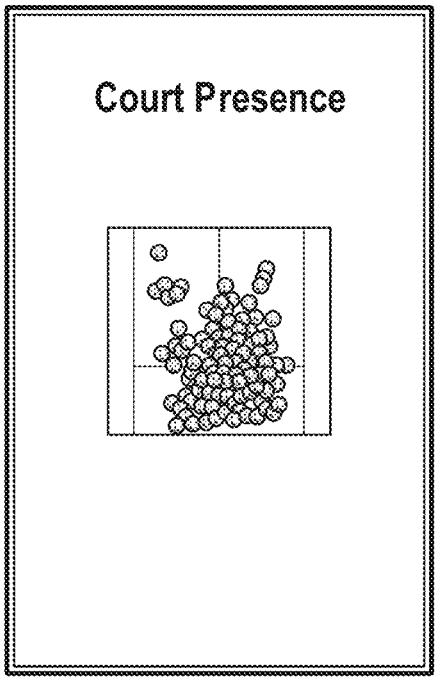

The various performance metrics determined at block 814 may be processed and displayed, e.g., a user device having a graphical user interface, to communicate the metrics to the or more players, as shown with regard to FIGS. 9A to 9E. FIGS. 9A to 9E are schematic illustrations of example user interfaces generated by an autonomous tennis assistant system in accordance with one or more example embodiments of the disclosure. For example, FIG. 9A illustrates the shot placement, e.g., the landing point of a tennis ball hit by a player on the tennis court, relative to the tennis court based on the type of stroke the player used to hit the tennis ball. FIG. 9B illustrates the total accuracy, e.g., percentage of balls hit by a player that did not land outside the boundary lines of the tennis court, or alternatively, percentage of balls hit by the player, whether or not the ball landed within the boundary lines of the tennis court, for a given player, as well as the ball speed, e.g., the speed of a given ball hit by the player, or alternatively, the average ball speed during a practice session or match. FIG. 9C illustrates the number of matches played by a given player, as well as the distance traveled by a given player. FIG. 9D illustrates the total number of shots completed by a given player, as well as the type of stroke the player used to hit the tennis ball for each shot. FIG. 9E illustrates the landing points of the tennis balls hit by a given player or during a given practice session or match. As will be understood by a person having ordinary skill in the art, the graphical user interface may be used to display any performance metric measured by the autonomous tennis assistant system.

It should be appreciated that the program module(s), applications, computer-executable instructions, code, or the like depicted in FIGS. 5 and 7 as being stored in the data storage 520 and 720, respectively, are merely illustrative and not exhaustive and that processing described as being supported by any particular module may alternatively be distributed across multiple module(s) or performed by a different module. In addition, various program module(s), script(s), plug-in(s), Application Programming Interface(s) (API(s)), or any other suitable computer-executable code hosted locally on the device 500, 700 and/or hosted on other computing device(s) accessible via one or more networks, may be provided to support functionality provided by the program module(s), applications, or computer-executable code depicted in FIGS. 5 and 7 and/or additional or alternate functionality. Further, functionality may be modularized differently such that processing described as being supported collectively by the collection of program module(s) depicted in FIGS. 5 and 7 may be performed by a fewer or greater number of module(s), or functionality described as being supported by any particular module may be supported, at least in part, by another module. In addition, program module(s) that support the functionality described herein may form part of one or more applications executable across any number of systems or devices in accordance with any suitable computing model such as, for example, a client-server model, a peer-to-peer model, and so forth. In addition, any of the functionality described as being supported by any of the program module(s) depicted in FIGS. 5 and 7 may be implemented, at least partially, in hardware and/or firmware across any number of devices.

It should further be appreciated that the device 500, 700 may include alternate and/or additional hardware, software, or firmware components beyond those described or depicted without departing from the scope of the disclosure. More particularly, it should be appreciated that software, firmware, or hardware components depicted as forming part of the device 500, 700 are merely illustrative and that some components may not be present or additional components may be provided in various embodiments. While various illustrative program module(s) have been depicted and described as software module(s) stored in data storage 520, 720, it should be appreciated that functionality described as being supported by the program module(s) may be enabled by any combination of hardware, software, and/or firmware. It should further be appreciated that each of the above-mentioned module(s) may, in various embodiments, represent a logical partitioning of supported functionality. This logical partitioning is depicted for ease of explanation of the functionality and may not be representative of the structure of software, hardware, and/or firmware for implementing the functionality. Accordingly, it should be appreciated that functionality described as being provided by a particular module may, in various embodiments, be provided at least in part by one or more other module(s). Further, one or more depicted module(s) may not be present in certain embodiments, while in other embodiments, additional module(s) not depicted may be present and may support at least a portion of the described functionality and/or additional functionality. Moreover, while certain module(s) may be depicted and described as sub-module(s) of another module, in certain embodiments, such module(s) may be provided as independent module(s) or as sub-module(s) of other module(s).

One or more operations of the methods, process flows, or use cases of FIGS. 1-9E may have been described above as being performed by a user device, or more specifically, by one or more program module(s), applications, or the like executing on a device. It should be appreciated, however, that any of the operations of the methods, process flows, or use cases of FIGS. 1-9E may be performed, at least in part, in a distributed manner by one or more other devices, or more specifically, by one or more program module(s), applications, or the like executing on such devices. In addition, it should be appreciated that the processing performed in response to the execution of computer-executable instructions provided as part of an application, program module, or the like may be interchangeably described herein as being performed by the application or the program module itself or by a device on which the application, program module, or the like is executing. While the operations of the methods, process flows, or use cases of FIGS. 1-9E may be described in the context of the illustrative devices, it should be appreciated that such operations may be implemented in connection with numerous other device configurations.

The operations described and depicted in the illustrative methods, process flows, and use cases of FIGS. 1-9E may be carried out or performed in any suitable order as desired in various example embodiments of the disclosure. Additionally, in certain example embodiments, at least a portion of the operations may be carried out in parallel. Furthermore, in certain example embodiments, less, more, or different operations than those depicted in FIGS. 1-9E may be performed.

Although specific embodiments of the disclosure have been described, one of ordinary skill in the art will recognize that numerous other modifications and alternative embodiments are within the scope of the disclosure. For example, any of the functionality and/or processing capabilities described with respect to a particular device or component may be performed by any other device or component. Further, while various illustrative implementations and architectures have been described in accordance with embodiments of the disclosure, one of ordinary skill in the art will appreciate that numerous other modifications to the illustrative implementations and architectures described herein are also within the scope of this disclosure.

Certain aspects of the disclosure are described above with reference to block and flow diagrams of systems, methods, apparatuses, and/or computer program products according to example embodiments. It will be understood that one or more blocks of the block diagrams and flow diagrams, and combinations of blocks in the block diagrams and the flow diagrams, respectively, may be implemented by execution of computer-executable program instructions. Likewise, some blocks of the block diagrams and flow diagrams may not necessarily need to be performed in the order presented, or may not necessarily need to be performed at all, according to some embodiments. Further, additional components and/or operations beyond those depicted in blocks of the block and/or flow diagrams may be present in certain embodiments.

Accordingly, blocks of the block diagrams and flow diagrams support combinations of means for performing the specified functions, combinations of elements or steps for performing the specified functions, and program instruction means for performing the specified functions. It will also be understood that each block of the block diagrams and flow diagrams, and combinations of blocks in the block diagrams and flow diagrams, may be implemented by special-purpose, hardware-based computer systems that perform the specified functions, elements or steps, or combinations of special-purpose hardware and computer instructions.

Program module(s), applications, or the like disclosed herein may include one or more software components including, for example, software objects, methods, data structures, or the like. Each such software component may include computer-executable instructions that, responsive to execution, cause at least a portion of the functionality described herein (e.g., one or more operations of the illustrative methods described herein) to be performed.

A software component may be coded in any of a variety of programming languages. An illustrative programming language may be a lower-level programming language such as an assembly language associated with a particular hardware architecture and/or operating system platform. A software component comprising assembly language instructions may require conversion into executable machine code by an assembler prior to execution by the hardware architecture and/or platform.

Another example programming language may be a higher-level programming language that may be portable across multiple architectures. A software component comprising higher-level programming language instructions may require conversion to an intermediate representation by an interpreter or a compiler prior to execution.

Other examples of programming languages include, but are not limited to, a macro language, a shell or command language, a job control language, a script language, a database query or search language, or a report writing language. In one or more example embodiments, a software component comprising instructions in one of the foregoing examples of programming languages may be executed directly by an operating system or other software component without having to be first transformed into another form.

A software component may be stored as a file or other data storage construct. Software components of a similar type or functionally related may be stored together such as, for example, in a particular directory, folder, or library. Software components may be static (e.g., pre-established or fixed) or dynamic (e.g., created or modified at the time of execution).

Software components may invoke or be invoked by other software components through any of a wide variety of mechanisms. Invoked or invoking software components may comprise other custom-developed application software, operating system functionality (e.g., device drivers, data storage (e.g., file management) routines, other common routines and services, etc.), or third-party software components (e.g., middleware, encryption, or other security software, database management software, file transfer or other network communication software, mathematical or statistical software, image processing software, and format translation software).

Software components associated with a particular solution or system may reside and be executed on a single platform or may be distributed across multiple platforms. The multiple platforms may be associated with more than one hardware vendor, underlying chip technology, or operating system. Furthermore, software components associated with a particular solution or system may be initially written in one or more programming languages, but may invoke software components written in another programming language.

Computer-executable program instructions may be loaded onto a special-purpose computer or other particular machine, a processor, or other programmable data processing apparatus to produce a particular machine, such that execution of the instructions on the computer, processor, or other programmable data processing apparatus causes one or more functions or operations specified in the flow diagrams to be performed. These computer program instructions may also be stored in a computer-readable storage medium (CRSM) that upon execution may direct a computer or other programmable data processing apparatus to function in a particular manner, such that the instructions stored in the computer-readable storage medium produce an article of manufacture including instruction means that implement one or more functions or operations specified in the flow diagrams. The computer program instructions may also be loaded onto a computer or other programmable data processing apparatus to cause a series of operational elements or steps to be performed on the computer or other programmable apparatus to produce a computer-implemented process.

Additional types of CRSM that may be present in any of the devices described herein may include, but are not limited to, programmable random access memory (PRAM), SRAM, DRAM, RAM, ROM, electrically erasable programmable read-only memory (EEPROM), flash memory or other memory technology, compact disc read-only memory (CD-ROM), digital versatile disc (DVD) or other optical storage, magnetic cassettes, magnetic tape, magnetic disk storage or other magnetic storage devices, or any other medium which can be used to store the information and which can be accessed. Combinations of any of the above are also included within the scope of CRSM. Alternatively, computer-readable communication media (CRCM) may include computer-readable instructions, program module(s), or other data transmitted within a data signal, such as a carrier wave, or other transmission. However, as used herein, CRSM does not include CRCM.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

That which is claimed is:

1. An interactive ball system comprising:

a housing comprising a ball inlet;

at least one wheel coupled to the housing;

an actuator configured to drive the at least one wheel;

a camera;

a ball container coupled to the ball inlet;

a ball ejector configured to eject balls from the interactive ball system, wherein the ball ejector is configured to rotate in a vertical direction relative to the housing;

a wireless radio; and a controller configured to:

determine a first location of a player relative to the interactive ball system;

determine a second location the interactive ball system is to move to based at least in part on the first location; and cause the interactive ball system to move to the second location using the at least one wheel.

2. The interactive ball system of claim 1, wherein the controller is further configured to:

determine a direction of the second location relative to a current location; and cause the housing to rotate, such that the camera is oriented toward the second location.

3. The interactive ball system of claim 1, wherein the controller is further configured to:

detect obstacles using the camera or one or more sensors.

4. The interactive ball system of claim 1, wherein the controller is further configured to:

autonomously navigate to the second location.

5. The interactive ball system of claim 1, wherein at least a portion of the housing is configured to rotate about a vertical axis.

6. The interactive ball system of claim 1, wherein the controller is further configured to:

determine a type of stroke the player is practicing;

determine, using the type of stroke, a first target location for a first ball to be ejected from the interactive ball system; and cause the first ball to be ejected towards the first target location after the interactive ball system is at the second location.

7. The interactive ball system of claim 1, wherein the interactive ball system is disposed on a first side of a tennis court and the camera is a first camera, the interactive ball system further comprising:

a base station disposed at or near a middle of the tennis court, wherein the base station is wirelessly connected to the controller; and a second camera disposed in the base station;

wherein the controller is configured to track movement of the player using the second camera.

8. The interactive ball system of claim 1, wherein the ball ejector is configured to rotate about a vertical axis of the interactive ball system.

9. The interactive ball system of claim 1, wherein the controller is further configured to:

determine a session mode; and determine a target location for a ball ejected by the interactive ball system based at least in part on the session mode.

10. The interactive ball system of claim 1, wherein the interactive ball system is an autonomous interactive ball system configured to retrieve tennis balls autonomously.

11. An interactive ball system comprising:

a housing;

a drive mechanism;

a first camera;

a ball container;

a ball ejector configured to eject balls from the interactive ball system; and a controller configured to:

determine a first location of a player relative to the interactive ball system;

determine a second location the interactive ball system is to move to based at least in part on the first location;

cause the interactive ball system to move to the second location using the drive mechanism;

determine a session mode; and determine a target location for a ball ejected by the interactive ball system based at least in part on the session mode.

12. The interactive ball system of claim 11, wherein the controller is further configured to:

determine a direction of the second location relative to a current location of the interactive ball system; and cause the housing to rotate, such that the camera is oriented toward the second location.

13. The interactive ball system of claim 11, wherein the controller is further configured to:

autonomously navigate to the second location.

14. The interactive ball system of claim 11, wherein at least a portion of the housing is configured to rotate about a vertical axis, and wherein the ball ejector is configured to rotate in a vertical direction relative to the housing.

15. The interactive ball system of claim 11, wherein the drive mechanism is configured to move the interactive ball system in at least a lateral direction.

16. The interactive ball system of claim 11, wherein the controller is further configured to:

determine a type of stroke the player is practicing;

determine, using the type of stroke, a first target location for a first ball to be ejected from the interactive ball system; and cause the first ball to be ejected towards the first target location after the interactive ball system is at the second location.

17. The interactive ball system of claim 11, wherein the interactive ball system is disposed on a first side of a tennis court, the interactive ball system further comprising:

a base station disposed at or near a middle of the tennis court, wherein the base station is wirelessly connected to the controller; and a second camera disposed in the base station;

wherein the controller is configured to track movement of the player using the second camera.

18. An interactive ball system comprising:

a housing;

a drive mechanism;

a first camera;

a ball container;

a ball ejector configured to eject balls from the interactive ball system, wherein the ball ejector is configured to rotate about a vertical axis of the interactive ball system; and a controller configured to:

determine a first location of a player relative to the interactive ball system;

determine a session mode;

determine a first target location based at least in part on the session mode and the first location;

determine a second location the interactive ball system is to move to based at least in part on the first target location;

cause the interactive ball system to move to the second location using the drive mechanism.

19. The interactive ball system of claim 18, wherein the controller is further configured to:

determine a type of stroke the player is practicing;

determine, using the type of stroke, a first target location for a first ball to be ejected from the interactive ball system; and cause the first ball to be ejected towards the first target location after the interactive ball system is at the second location.

20. The interactive ball system of claim 18, wherein the interactive ball system is an autonomous interactive ball system configured to retrieve tennis balls autonomously.

* * * * *